US007424979B1

(12) United States Patent
Chen

(10) Patent No.: US 7,424,979 B1
(45) Date of Patent: Sep. 16, 2008

(54) FRAGRANCE VIBRATING AND NEBULIZING MODULE

(75) Inventor: Thaiping Chen, Kaohsiung (TW)

(73) Assignees: Evergreat Electronic Co., Ltd., Kaohsiung (TW); Chin-Wan Lin, Kaohsiung (TW); Yung-Shing Lin, Yongkang (TW)

( * ) Notice: Subject to any disclaimer, the term of this patent is extended or adjusted under 35 U.S.C. 154(b) by 0 days.

(21) Appl. No.: 12/014,926

(22) Filed: Jan. 16, 2008

(51) Int. Cl.
*B05B 1/08* (2006.01)
*B05B 3/04* (2006.01)

(52) U.S. Cl. ..... 239/102.1; 239/102.2

(58) Field of Classification Search ..... 239/4, 239/44, 47, 49, 50, 102.1, 102.2, 145, 302, 239/326

See application file for complete search history.

(56) References Cited

U.S. PATENT DOCUMENTS 6,450,419 B1 * 9/2002 Martens et al. ..... 239/102.1
6,706,988 B1 * 3/2004 Helf et al. ..... 200/553
7,017,829 B2 * 3/2006 Martens et al. ..... 239/44
2003/0218077 A1 * 11/2003 Boticki et al. ..... 239/102.1
2004/0108390 A1 * 6/2004 Helf et al. ..... 239/4
2006/0011739 A1 * 1/2006 Jaworski ..... 239/102.2
2008/0011875 A1 * 1/2008 Sipinski et al. ..... 239/102.2

* cited by examiner

*Primary Examiner*—Darren W Gorman
(74) *Attorney, Agent, or Firm*—Alan Kamrath; Kamrath & Associates PA

(57) ABSTRACT

An improved fragrance vibrating and nebulizing module comprises a holding unit which is installed on an opening of a container, so that a plurality of retainers can retain a wick in place. Two engaging portions formed on an outer periphery of the holding unit can cooperate with guide grooves formed on a central annular portion of a vibrating and nebulizing base and be rotationally connected to be in place. After a receiving space of a top retaining unit is mounted with a resilient element and a vibrating plate, the resilient element and the vibrating plate are retained in place by a resilient retainer. Through holes of the top retaining unit are connected with resilient tenons on the vibrating and nebulizing base. While in use, the vibrating and nebulizing module can draw up a fragrance via the wick, so that the fragrance is nebulized and dispersed in contact with outside air.

2 Claims, 6 Drawing Sheets

FRAGRANCE VIBRATING AND NEBULIZING MODULE

BACKGROUND OF THE INVENTION

1. Technical Field

The present invention relates to a fragrance vibrating and nebulizing device, and more particularly to an improved fragrance vibrating and nebulizing module with a reduced number of components, wherein the vibrating and nebulizing module installed on a container having a fragrance therein can be actuated so that the fragrance drawn up by a wick immersed in the container is in contact with outside air and nebulized and dispersed by the vibrating and nebulizing module.

2. Description of Related Art

Devices for nebulizing a liquid held in a container have a variety of types and configurations, among which is a dispensing assembly with a nebulizing device. In this type of dispensing assemblies, a tube containing a wick therein is immersed in a container, and an upper end of the tube is retained in place by a lug. The lug is covered with a cap so that the resultant container assembly can be placed into a cover to a side thereof. A battery-driven switching starter is disposed against another side of the container assembly for driving a nebulizing process of a liquid in the container, wherein the liquid is nebulized and sprayed outwards through a hole formed on a side of the cover. The aforementioned dispensing assembly to be installed in a liquid in a container for nebulizing the liquid has numerous complicated components and requires an onerous assembling procedure, which increases an overall cost of the dispensing assembly.

SUMMARY OF THE INVENTION

In view of the complexity and inconvenience associated with the assembling of existing dispensing assemblies for nebulizing a liquid in a container, the present invention provides an improvement in which a vibrating and nebulizing module with a reduced number of components can be installed on an upper end of a container having a fragrance therein, so that the fragrance drawn up by a wick immersed in the container can be in contact with outside air and nebulized and dispersed by the vibrating and nebulizing module.

A primary objective of the present invention is to provide an improved fragrance vibrating and nebulizing module with a compact structure, wherein a holding unit is installed on an opening of a container having a fragrance therein, so that a plurality of retainers extending downwardly from the holding unit can retain in place a wick immersed in the container. Two engaging portions formed on an outer periphery of the holding unit can be rotationally connected with two upwardly extending, inclined guide grooves formed on a central annular portion of a vibrating and nebulizing base, so that dents formed respectively on lower portions of the two engaging portions are engaged with protrusions formed respectively at upper limits of the guide grooves. A receiving space extending downwardly from a top retaining unit is sequentially mounted with a resilient element and a vibrating plate. The resilient element and the vibrating plate are retained in place by a resilient retainer. Through holes on a periphery of the top retaining unit are then connected with resilient tenons provided respectively on upper ends of supporting portions extending from corresponding locations on the vibrating and nebulizing base. While in use, the vibrating and nebulizing module installed on top of the container can draw up the fragrance via the wick immersed in the container, so that the fragrance is in contact with outside air and then nebulized and dispersed by the vibrating and nebulizing module.

A secondary objective of the present invention is to provide an improved fragrance vibrating and nebulizing module as described above, wherein the top retaining unit mounted on the vibrating and nebulizing base is provided with resilient connecting sections extending between the central receiving space and each of the through holes on the periphery of the top retaining unit. As a result, the vibrating plated downwardly biased by the resilient element is allowed to adjust to a better position when in contact with the wick, in order not to compress the wick excessively.

DETAILED DESCRIPTION OF THE PREFERRED EMBODIMENT

Figure 1:
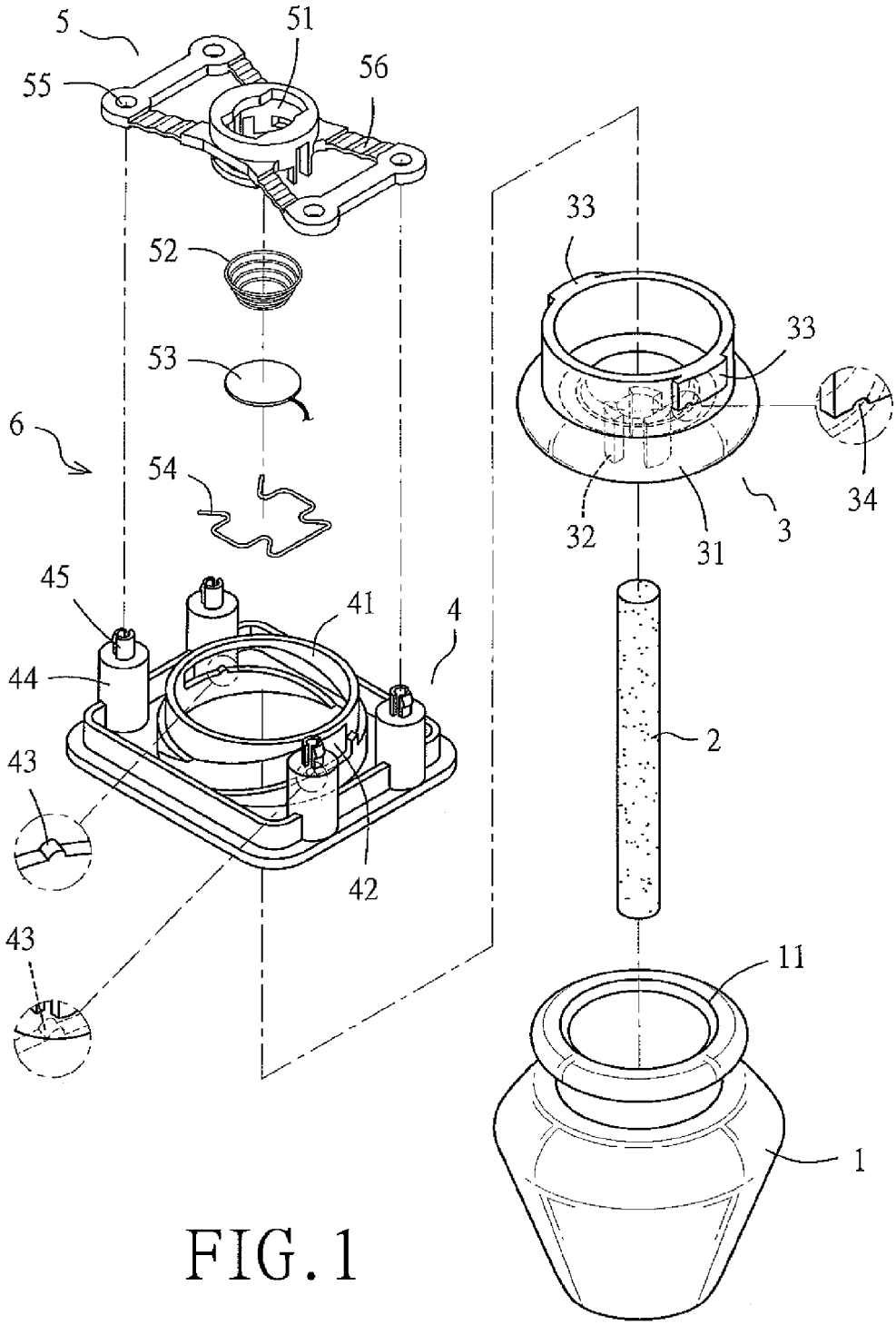
FIG. 1 is a perspective exploded view of components of a vibrating and nebulizing module according to the present invention and a container.

Referring to FIG. 1, an improved fragrance vibrating and nebulizing module according to the present invention is applied to a container 1 with a wick 2 immersed therein and comprises a holding unit 3 installed on an opening 11 of the container 1. The holding unit 3 is assembled on an upper side thereof with a vibrating and nebulizing base 4 and a top retaining unit 5 that constitute a vibrating and nebulizing module 6.

Therein, the holding unit 3 has an inwardly curved covering section 31, a plurality of retainers 32, and two corresponding engaging portions 33, wherein the covering section 31 is formed on an outer periphery of a lower portion of the holding unit 3, the retainers 32 are extending downwardly from a central portion of the holding unit 3, the two engaging portions 33 are formed on an outer periphery of an upper portion of the holding unit 3, and the two engaging portions 33 are each provided with a dent 34 at a lower portion thereof.

The vibrating and nebulizing base 4 has two upwardly extending, inclined guide grooves 42 on a central annular portion 41 thereof, wherein the two guide grooves 42 are each provided with a protrusion 43 at an upper limit thereof. The vibrating and nebulizing base 4 further includes a supporting portion 44 extending from each of corners thereof, wherein each of the supporting portions 44 is formed with a resilient tenon 45 on an upper end thereof.

Figure 3A:
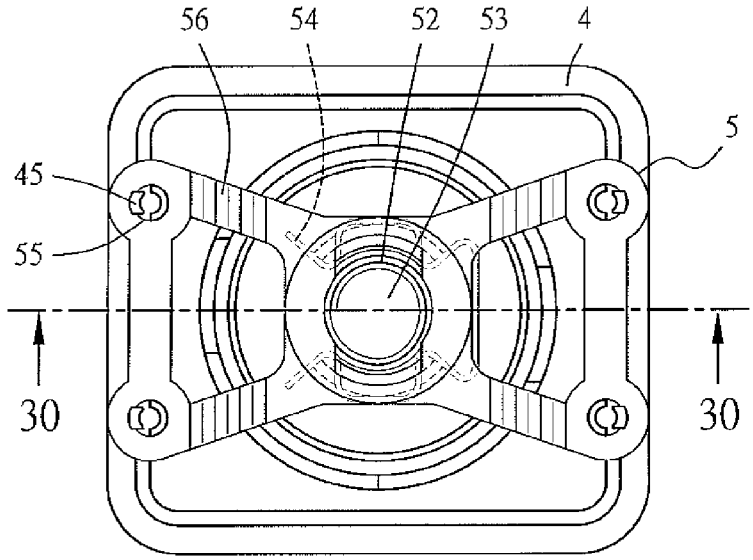
FIG. 3A is a schematic view of the assembly of the vibrating and nebulizing module according to the present invention.
Figure 3B:
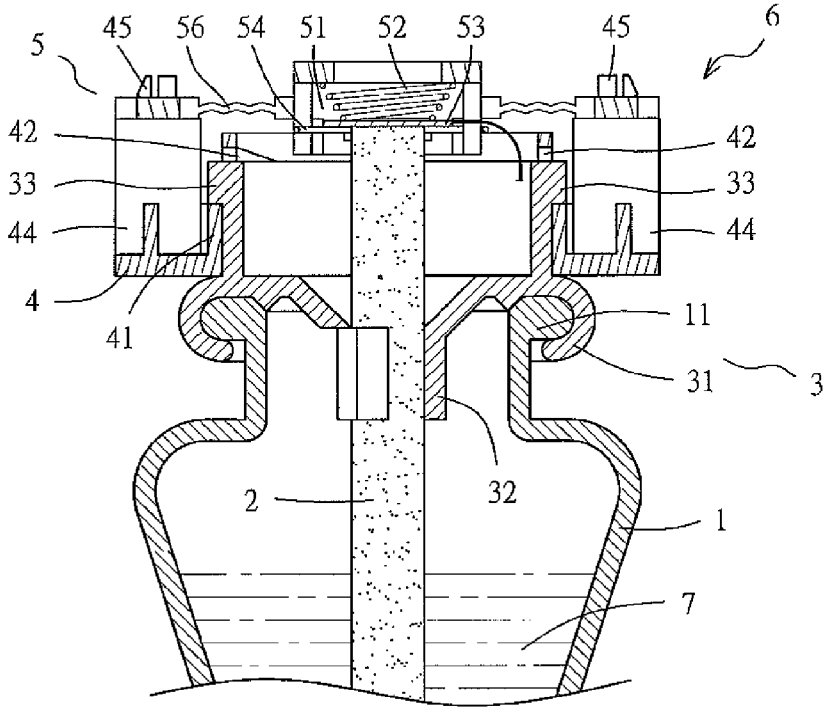
FIG. 3B is a cross-sectional view of the vibrating and nebulizing module and container, taken along the line designated by 30-30 in FIG. 3A.

The top retaining unit 5 has a receiving space 51 extending downwardly from a central portion thereof for receiving a resilient element 52 and a vibrating plate 53, wherein the vibrating plate 53 is connected at an end thereof with a circuit board that can be timed to cause vibration. The downwardly biased vibrating plate 53 is retained in the receiving space 51 by a resilient retainer 54, as shown in FIG. 3. The top retaining unit 5 further includes through holes 55 at corners thereof and defines a resilient connecting section 56 extending between the central receiving space 51 and each of the through holes 55.

Figure 2:
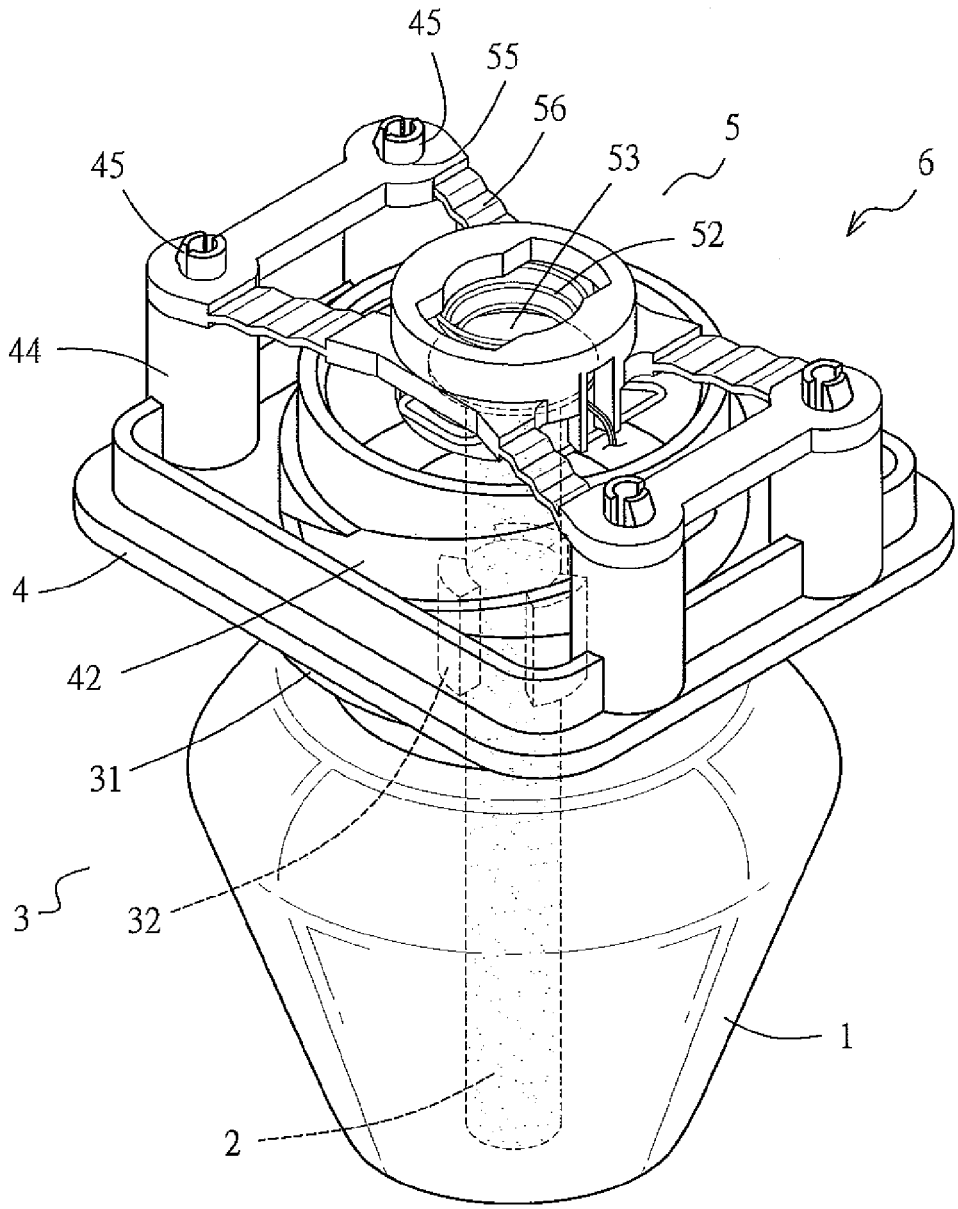
FIG. 2 shows an appearance of an assembly of the vibrating and nebulizing module according to the present invention and the container.
Figure 4A:
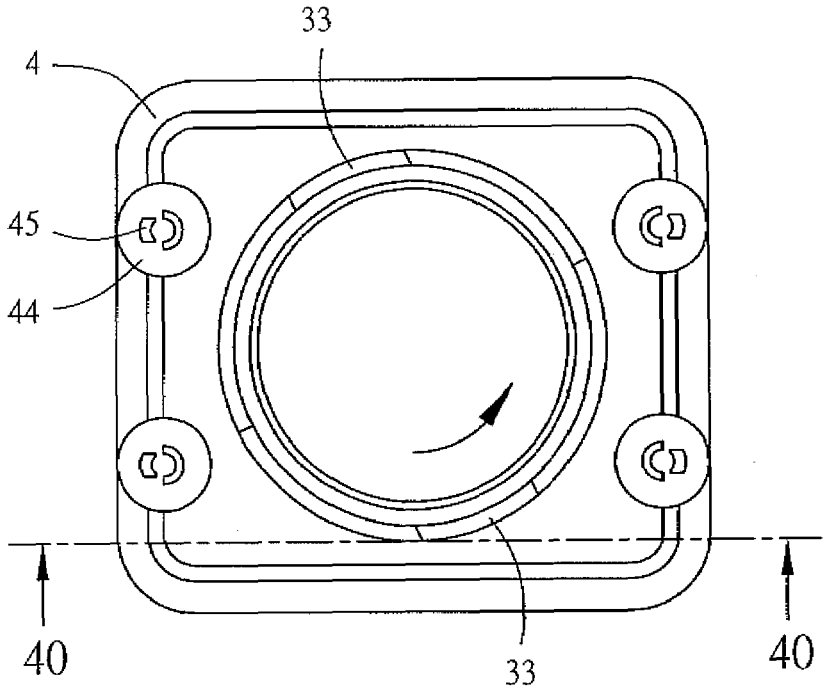
FIG. 4A is a schematic view of a holding unit and a vibrating and nebulizing base according to the present invention before the two components are fastened together.
Figure 4B:
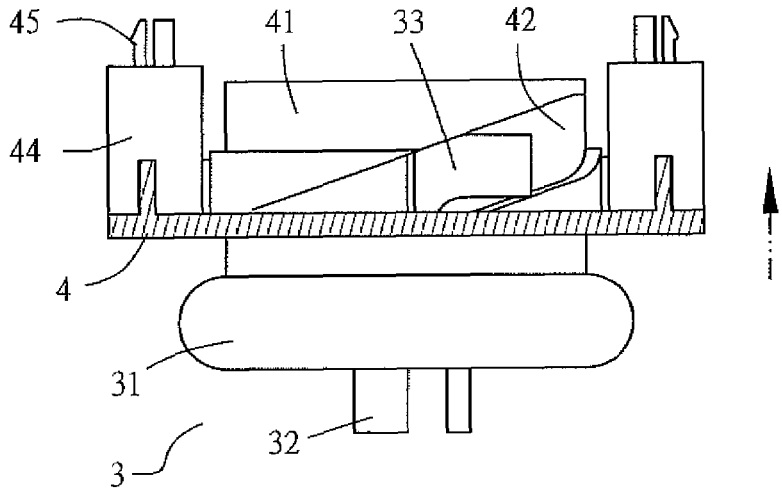
FIG. 4B is a cross-sectional view of the holding unit and vibrating and nebulizing base, taken along the line designated by 40-40 in FIG. 4A.
Figure 5A:
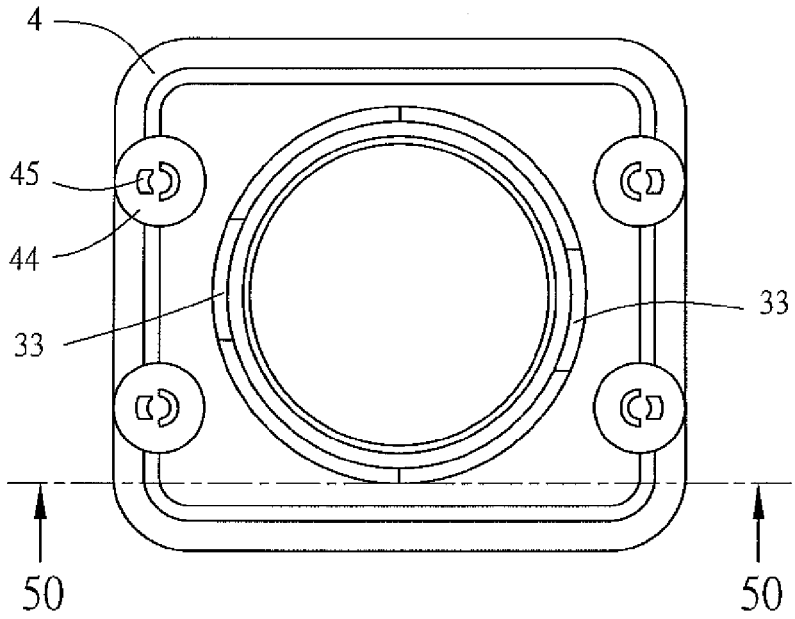
FIG. 5A is a schematic view of the holding unit and the vibrating and nebulizing base according to the present invention after the two components are fastened together.
Figure 5B:
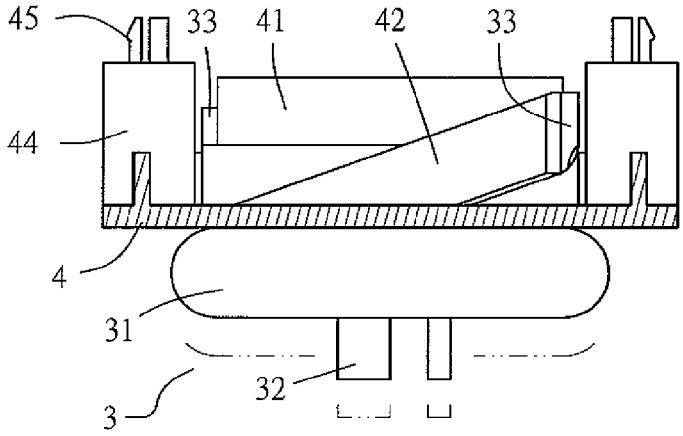
FIG. 5B is a cross-sectional view of the holding unit and vibrating and nebulizing base, taken along the line designated by 50-50 in FIG. 5A.

Referring to FIGS. 3 to 5, when the holding unit 3, the vibrating and nebulizing base 4 and the top retaining unit 5 are to be installed on the upper end of the container 1, the curved covering section 31 formed on the lower portion of the holding unit 3 is mounted onto an outer periphery of the opening 11 of the container 1, so that the plurality of retainers 32 extending downwardly from the central portion of the holding unit 3 retain in place the wick 2 immersed in the container 1. Then, as shown in FIG. 4, the two corresponding engaging portions 33 formed on the upper portion of the holding unit 3 are rotationally connected with the two upwardly extending, inclined guide grooves 42 on the central annular portion 41 of the vibrating and nebulizing base 4. When the two engaging portions 33 are rotated to a highest position in the guide grooves 42, as shown in FIG. 5, the dents 34 formed respectively on the lower portions of the two engaging portions 33 are engaged with the protrusions 43 formed respectively at the upper limits of the guide grooves 42. Then, the resilient element 52 and the vibrating plate 53 are placed into the receiving space 51, and the resilient element 52 and the vibrating plate 53 are retained in place by the resilient retainer 54. Next, the through holes 55 on the periphery of the top retaining unit 5 are connected with the resilient tenons 45 formed on the upper ends of the supporting portions 44 extending from corresponding locations on the vibrating and nebulizing base 4, as shown in FIG. 3. It should be noted that, when the top retaining unit 5 is mounted on the vibrating and nebulizing base 4, the resilient connecting sections 56 formed between the central receiving space 51 and each of the through holes 55 of the top retaining unit 5 allow the resiliently and downwardly biased vibrating plate 53 to adjust to a better position when in contact with the wick 2 immersed in the container 1, so as not to compress the wick 2 excessively. Thus, the fragrance vibrating and nebulizing module 6 is formed, as shown in FIG. 2.

As shown in FIG. 3, when the vibrating and nebulizing module 6 installed on the container 1 is used for fragrance spraying, a fragrance 7 drawn up by the wick 2 immersed in the container 1 is brought into contact with outside air and is nebulized and dispersed by the resilient element 52 and the vibrating plate 53 in the vibrating and nebulizing module 6, wherein the vibrating plate 53 is driven by the circuit board connected therewith to start an up-and-down vibration. As a result, the fragrance 7 in the container 1 is successfully nebulized through vibration by the vibrating and nebulizing module 6 with a simple structure.

Figure 6:
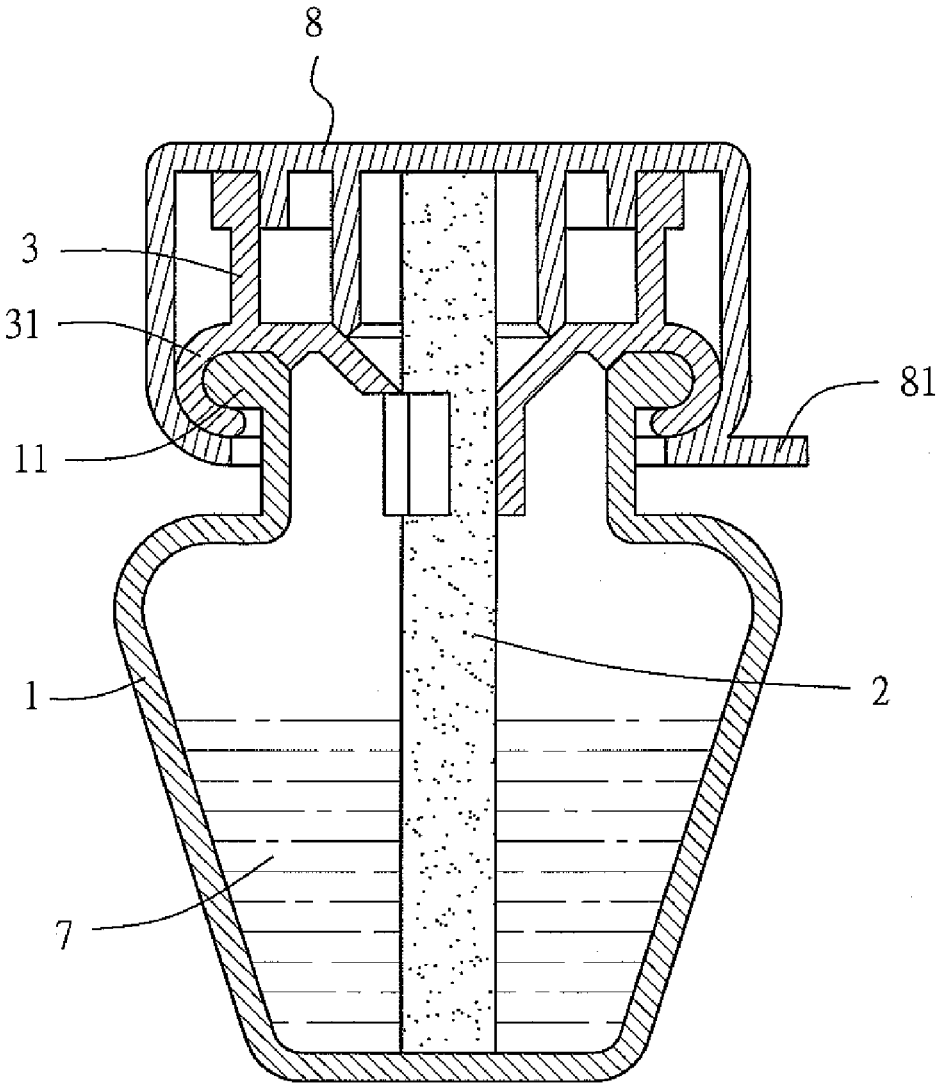
FIG. 6 is a schematic cross-sectional view of a container having a fragrance therein before use.

As shown in FIG. 6, When the container 1 having the fragrance 7 therein and the wick 2 immersed therein is not in use, a cap 8 having a pulling portion 81 at an end thereof is placed directly on an outer periphery of the holding unit 3 installed on the opening 11 of the container 1.

When used with a container having a fragrance therein, the aforementioned vibrating and nebulizing module provides the following advantages:

1. The entire vibrating and nebulizing module has a reduced number of components and can be conveniently assembled for providing a desired vibrating and nebulizing effect;

2. The top retaining unit mounted on top of the vibrating and nebulizing module is allowed to adjust to an appropriate position when in contact with the wick immersed in the container so as not to compress the protruding wick excessively; and 3. The vibrating and nebulizing module can be easily assembled with or detached from a container containing a fragrance and having a wick immersed therein.

What is claimed is:

1. An improved fragrance vibrating and nebulizing apparatus having a simple structure applicable to a container having a fragrance therein, comprising a holding unit installed on an opening of the container, so that a plurality of retainers extending downwardly from the holding unit can retain in place a wick immersed in the container, wherein the opening of the container on which the holding unit is installed is adapted to be covered with a cap, wherein the holding unit has two corresponding engaging portions formed on an outer periphery thereof, the two engaging portions each including a dent on a lower portion thereof so that a vibrating and nebulizing module can be mounted thereon, and wherein the vibrating and nebulizing module comprises:

a vibrating and nebulizing base having two upwardly extending, inclined guide grooves on a central annular portion thereof, wherein the two guide grooves are each provided with a protrusion at an upper limit thereof, the vibrating and nebulizing base further including a supporting portion extending from each of corners thereof, and each of the supporting portions is formed with a resilient tenon on an upper end thereof; and a top retaining unit having a receiving space extending downwardly from a central portion thereof for receiving a resiliently and downwardly biased resilient element and a vibrating plate, wherein the resiliently and downwardly biased resilient element and vibrating plate are retained in the receiving space by a resilient retainer, and the top retaining unit further includes through holes at corners thereof;

wherein, the holding unit, the vibrating and nebulizing base and the top retaining unit are assembled such that the two corresponding engaging portions formed on the outer periphery of the holding unit are rotationally connected with the two upwardly extending, inclined guide grooves formed on the central annular portion of the vibrating and nebulizing base, so that the dents formed respectively on the lower portions of the two engaging portions are engaged with the protrusions formed respectively at upper limits of the guide grooves; and the through holes at the corners of the top retaining unit are connected with the resilient tenons formed on the upper ends of the supporting portions extending from corresponding corners on the vibrating and nebulizing base; whereby the vibrating plate which is thereby provided at a lower portion of the top retaining unit in the vibrating and nebulizing module installed on the container is in contact with an end of the wick immersed in the container, so that fragrance drawn up by the wick is in contact with outside air and nebulized and dispersed by the vibrating and nebulizing module.

2. The improved fragrance vibrating and nebulizing apparatus as claimed in claim 1, wherein the top retaining unit mounted on the vibrating and nebulizing base is provided with resilient connecting sections extending between the central receiving space and each of the through holes, so that the vibrating plate resiliently and downwardly biased by the resilient element is allowed to adjust to a better position when in contact with the end of the wick immersed in the container, in order not to compress the wick excessively.

* * * * *